United States Patent [19]

Dial, Sr.

[11] 4,229,909

[45] Oct. 28, 1980

[54] TOOL GRINDING MACHINE

[75] Inventor: Charles E. Dial, Sr., Lenoir City, Tenn.

[73] Assignee: The United States of America as represented by the United States Department of Energy, Washington, D.C.

[21] Appl. No.: 22,895

[22] Filed: Mar. 22, 1979

[51] Int. Cl.[3] ..... B24B 3/34

[52] U.S. Cl. ..... 51/165.75; 51/124 R; 51/218 R

[58] Field of Search ..... 51/124 R, 234, 165.75, 51/218 A, 218 R

[56] References Cited

U.S. PATENT DOCUMENTS

| | | | |
|---|---|---|---|
| 2,144,095 | 1/1939 | Zwick | 51/124 |
| 2,454,472 | 11/1948 | Monkley | 51/124 R X |
| 2,971,363 | 2/1961 | Rockafellow | 51/165.75 |
| 2,982,058 | 5/1961 | Maitenaz | 51/124 R |
| 3,857,200 | 12/1974 | Hill | 51/165.75 |
| 4,010,575 | 3/1977 | Henry | 51/234 |

*Primary Examiner*—Harold D. Whitehead

*Attorney, Agent, or Firm*—James E. Denny; Stephen D. Hamel; Earl L. Larcher

[57] ABSTRACT

The present invention relates to an improved tool grinding mechanism for grinding single point diamond cutting tools to precise roundness and radius specifications. The present invention utilizes a tool holder which is longitudinally displaced with respect to the remainder of the grinding system due to contact of the tool with the grinding surface with this displacement being monitored so that any variation in the grinding of the cutting surface such as caused by crystal orientation or tool thickness may be compensated for during the grinding operation to assure the attainment of the desired cutting tool face specifications.

5 Claims, 1 Drawing Figure

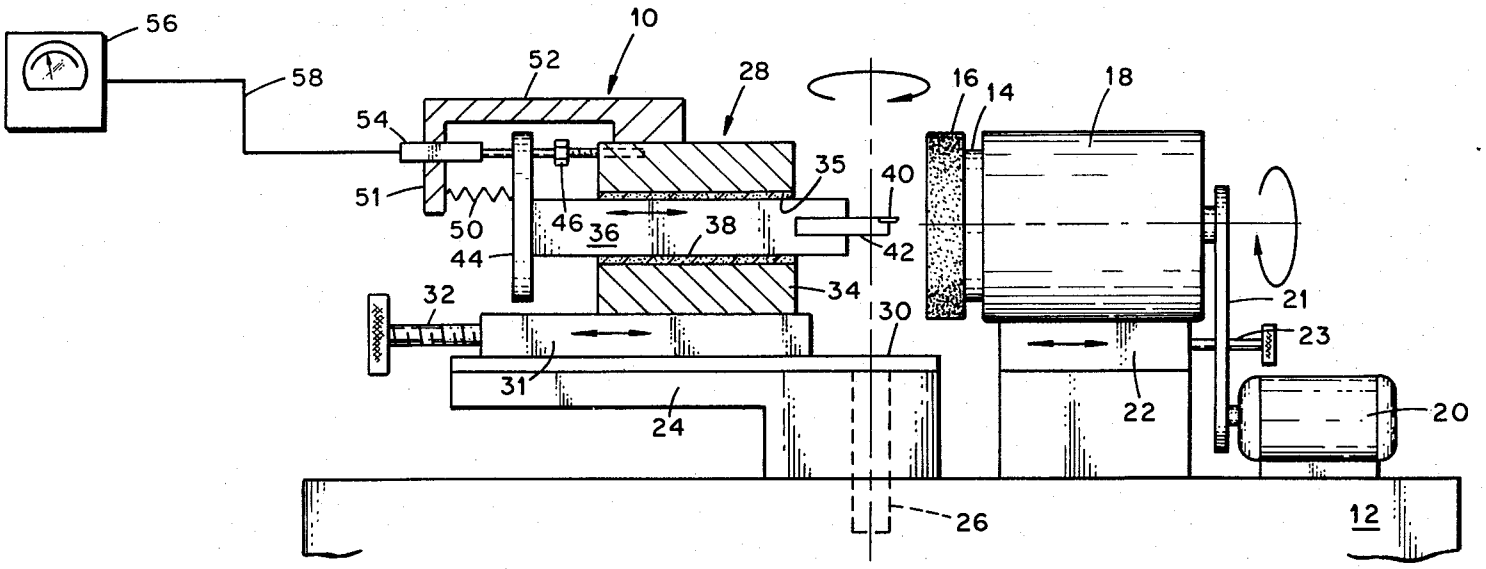
10
12
14
16
18
20
21
22
23
24
26
28
30
31
32
34
35
36
38
40
42
44
46
50
51
52
54
56
58

TOOL GRINDING MACHINE

This invention was made in the course of, or under, a contract with the U.S. Department of Energy.

BACKGROUND OF THE INVENTION

The present invention is directed to an improved tool grinding machine and, more particularly, to a tool grinding machine that incorporates components which provides for monitoring the grinding rate on the tool so that variations in hardness and thickness of the tool may be readily compensated for during the grinding procedure.

The technological requirements of many present day systems require that the components of the system be machined to very precise specifications. In order to provide this precise machining the machine such as a lathe, boring mill, or other component machining mechanisms requires the use of special cutting tools. For example, single point diamond and tungsten carbide cutting tools have been used successfully in highly precision machines for accurate and precise machine operations. More particularly, single point diamond tools with a radiused cutting edge are readily utilized for machining laser beam reflecting mirrors envisioned for use in the laser fusion program. Such cutting tools require a roundness accuracy of less than 30 microinches and a radius tolerance of no more than about 0.001 inch for cutting the mirrors to within the predetermined finished surface tolerances. Single point cutting tools including those made of diamond and other materials, such as tungsten carbide, which are ground to precise specifications such as described above, are of limited availability and are relatively expensive.

To grind a single point diamond tool with a desired point radius and within the roundness tolerances as previously practiced, the tool was mounted in a holder affixed to an arm capable of swinging the tool about an axis parallel to the face of the grinding wheel for forming an arc to grind a point radius on a single point tool. The point radius may be readily changed by relocating the pivot point of the arm.

The major problem associated with the precision grinding of single point diamond tools as previously practiced is due to the fact that the apparent hardness of the diamond varies along the edge being ground as caused by the orientation of the diamond crystals so as to introduce a considerable variance in the grinding rate on the cutting edge. In other words, the "softer" surfaces may be ground at a considerably faster rate than the "harder" surface areas. Another variable in diamond tools which introduces some difficulty in providing a precision ground tool is due to irregularities in thickness of the cutting tool caused by variations in the size and shape of diamonds used for cutting tools. These variations in thickness have a considerable affect upon the grinding rate since the thinner cross sections are usually ground at a faster grinding rate than the thicker sections in sections of similar hardness.

BRIEF SUMMARY OF THE INVENTION

The primary objective or goal of the present invention is to provide an improved tool grinding machine for grinding single point diamond cutting tools with precise radii and roundness characteristics regardless of the diamond crystal orientation or thickness of the edge of the diamond cutting tool being ground. This goal is achieved by an improved tool grinding machine which comprises a rotatable grinding wheel, a tool holding means for holding the tool to be ground to the desired tolerances, bearing means supporting the tool holding means so as to permit relative movement of the tool holding means with respect to the bearing means along a path in a single plane, pivotal means coupled to the bearing means for rotating the tool holding means over a preselected arc about an axis perpendicular to the aforementioned plane and parallel to the face of the grinding wheel, moving means disposed intermediate the pivotal means and the bearing means for effecting displacement of the bearing means and the tool holding means supported thereby along the first mentioned plane, sensing means coupled to the tool holding means for sensing relative movement of the tool holding means within the bearing means when the tool is placed in contact with the grinding wheel by the moving means and when the tool holding means is displaced about said arc. Bias means are associated with the bearing means for continually urging the tool holding means towards the grinding wheel so that when the contact is established with the grinding wheel the bias means provides a resistance against the displacement of the holding means within the bearing means in a direction away from the grinding wheel. When the tool holding means are displaced against the bias means the sensing means provide an indication of the deviation from a desired preset radius.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated. While the improved tool grinding mechanism of the present invention is primarily directed to the grinding of single point diamond tools, it will appear clear that any cutting tool where certain roundness and radius characteristics are desired may be readily ground in the tool grinding mechanism of the present invention.

DETAILED DESCRIPTION OF THE DRAWING

In the accompanying drawing the FIGURE is a somewhat schematic view partly broken away showing details of the improved tool grinding mechanism of the present invention.

DETAILED DESCRIPTION OF THE INVENTION

As shown in the accompanying FIGURE, the tool grinding mechanism of the present invention as generally indicated at numeral 10 comprises a base or support structure 12 upon which a spindle 14 is disposed. A grinding wheel of a suitable configuration and of a material, such as diamond grit, for grinding single point diamond cutting tools is generally shown at 16. This grinding wheel 16 may be readily coupled to the spindle 14. This spindle 14 is preferably driven through an air bearing 18 to minimize vibration at the grinding head. A spindle drive motor 20 is coupled through a suitable belt arrangement 21 to the spindle. Intermediate the bearing 18 and the base 12 is a slide 22 including a lead screw 23 which may be used for displacing the grinding wheel 14 along a longitudinal plane parallel to the axis of rotation of the grinding wheel so as to change or vary the circumference or the radius of the cutting tool as will be described in greater detail below.

In order to grind a cutting tool in accordance with the present invention with a precise radius and roundness, a swing arm 24 is cantileverly attached to the base 12 by a suitable pin 26 which is preferably bearing mounted to facilitate the rotation of the swing arm. This pin 26 provides the point about which the swing arm rotates with this axis of rotation being parallel to the face of grinding wheel 16 and perpendicular to the axis of rotation of the latter. The swing arm 24 extends cantileverly from the pin 26 in a direction away from the grinding wheel 16 and along a plane parallel to the axis of rotation of the grinding wheel 16.

The tool holder assembly generally shown at 28 is carried by the swing arm 24 and comprises a slideway 30 attached to the swing arm and includes a carriage 31 and a lead screw 32. A housing 34 is fixed to the carriage 31 for displacement therewith in response to rotation of the lead screw 32 with this displacement of the housing being along a plane perpendicular to the axis of rotation of the swing arm 24. The housing 34 is provided with a throughgoing passageway 35 for receiving a tool holder 36 of a suitable configuration, e.g., square, and of a length greater than the housing 34 so as to extend or project from the housing 34 at either end of the passageway 35 a distance of approximately 1 to 2 inches. Intermediate the housing 34 and the tool holder 36 contained therein is a bearing structure 38 for facilitating the displacement of the tool holder with the housing 34 along a plane perpendicular to the axis of rotation of the swing arm 24. This bearing 38 is preferably an air bearing to facilitate the displacement of the tool holder as well as minimize errors in the grinding operation due to friction or the like during displacement of the tool holder 36. At one end of the tool holder 36 the tool 40 to be ground is attached to the tool holder 36 by a conventional tool clamping arrangement 42. A flange 44 is affixed to the opposite end of the tool holder 36 projecting from the housing 34. This flange 44 may be of a discoidal or any other suitable configuration.

A motion-limiting mechanism or stop 46 is disposed between the flange 44 and the housing 34 to limit movement or displacement of the tool holder with respect to the housing in the direction towards the grinding wheel 16. This stop 46 is preferably of a readily variable length, such as provided by a threaded bolt engaging suitable threads in the housing 34 as shown.

Bias means are placed on the side of the flange opposite the stop 46 to continuously urge the tool holder 36 towards the grinding wheel 16 and against the stop 46 as well as provide resistance against displacement of the tool holder 36 away from the grinding wheel 16 when the tool 40 is brought into contact with the grinding wheel 16 by the rotation of the swing arm or the operation of the slide drives 23 or 32. This bias means is provided by a compression spring 50 which bears against an arm 51 of a generally C-shaped bracket 52 which is attached to the housing 34 and overlaps or projects over the flange 44 to a location spaced from the tool holder flange 44. Also attached to the arm 51 of bracket 52 is a linear variable differential transducer (LVDT) 54 which bears against the flange 44 so that any relative movement of the tool holder 36 with respect to the housing 34 will provide a signal at the LVDT 54. This signal which is indicative of the tool holder displacement in the housing 34 can be utilized in a suitable readout mechanism to provide a measurement of the displacement of the tool holder 36 in the tool holder housing. A suitable readout mechanism is generally shown as a meter 56 which can be a conventional amplifier readout meter. This meter is coupled to LVDT 54 via a lead 58. The necessary circuitry for providing the electrical signal from the LVDT 54 as well as the power for the meter 56 is not shown, but such a system or systems are conventionally employed and are well within the skill of the art.

In operation the tool 40 to be ground is placed in the tool clamp 42 and the tool holder housing 34 is moved toward the grinding wheel 16 on the slide 30 until the tool 40 contacts the face of the grinding wheel 16 and a load placed upon the tool 40 sufficient to displace the tool holder flange 44 away from the stop 46 and bear against the bias of spring 50. At this time the meter 56 is preferably set at a null point and the grinding of the tool initiated. Any irregularities in the tool face being ground that are due to variable hardness and thicknesses will be readily indicated on the meter 56 as the grinding proceeds which instantly gives the operator an indication of any grinding situation. During such grinding the tool 40 is respectively displaced toward or away from the grinding wheel 16 by the force of the spring when the grinding wheel is contacted by a soft or hard area on the face of the diamond tool. The monitoring of this linear movement of the tool holder 36 by the meter 56 allows the operator to concentrate grinding on areas of the tool face to assure a true circumference and radius. The tool 40 is ground to the desired accurate radius when the meter 56 remains in a neutral position as the swing arm 24 is displaced through its full arc.

It will be seen that the improved grinding tool system of the present invention facilitates and provides for continuous monitoring of the radius and contour of the tool face during the grinding operation so that the entire grinding operation may be completed without removing the tool from the grinding machine or without frequently stopping the machine to measure the tool as previously required. Also, by employing the improved grinding mechanism of the present invention the tool may be readily centered on its radius center line prior to grinding by observing the amplifier readout meter 56 while rotating the tool against the grinding wheel. This centering of the tool is a significant improvement over the previously used methods such as employing a microscope and affecting the alignment of the tool by centering to a reticle line on both corners of the tool. This aligning of the tool to the center line by using the present invention requires a duration of about one-fourth of that previously required. Further, the force of the tool against the grinding wheel during tool grinding is readily controlled to minimize wear on the wheel.

What is claimed is:

1. A tool grinding machine comprising a rotatable grinding wheel, tool holding means for holding a tool to be ground to desired tolerances, bearing means for supporting the tool holding means in a relatively movable manner therewith along a path in a single plane, pivotal means coupled to said bearing means for rotating the tool holding means over a preselected arc on an axis perpendicular to said plane and parallel to the face of the grinding wheel, moving means disposed intermediate said pivotal means and said bearing means for effecting relative displacement of said bearing means and the tool holding means supported thereby along said plane, sensing means coupled to said tool holding means for sensing said relative movement of said tool holding means within said bearing means when the tool is placed in contact with said grinding wheel by said moving means and when the tool holding means is displaced about said arc while in said contact with the grinding wheel, and spring means engaging said tool holding means for continually urging the latter along said path towards said grinding wheel.

2. A tool grinding machine as claimed in claim 1, wherein said bearing means comprises a housing which has a throughgoing passageway and is supported by said moving means, said tool holding means comprises a cylindrical body disposed in said passageway with a portion of said body adjacent each end thereof projecting from said housing, a bearing is disposed between said body and said housing, said tool is supported at one end of said body, and wherein the spring means engage the other end of said body.

3. A tool grinding machine as claimed in claim 2, wherein bracket means are carried by said housing and overlap said other end of said body, wherein said spring means comprises a compression spring disposed between and in contact with said other end of said body and said bracket means.

4. A tool grinding machine as claimed in claim 3, wherein a flange is attached to said other end of said body, said spring contacts one side of said flange, and wherein adjustable stop means are disposed intermediate said housing and the side of the flange opposite said one side.

5. A tool grinding machine as claimed in claim 3, wherein said sensing means comprises a linear variable differential transducer carried by said bracket means and engages said other end of said body, and wherein meter means are coupled to said transducer for receiving a signal from the latter indicative of the movement of said body in said housing.

* * * * *